US006244775B1

(12) United States Patent
Oike

(10) Patent No.: US 6,244,775 B1
(45) Date of Patent: Jun. 12, 2001

(54) WRITING IMPLEMENT

(75) Inventor: Shigeru Oike, Aichi (JP)

(73) Assignee: The Pilot Ink Co., Ltd., Aichi (JP)

( * ) Notice: Subject to any disclaimer, the term of this patent is extended or adjusted under 35 U.S.C. 154(b) by 0 days.

(21) Appl. No.: 09/676,668

(22) Filed: Oct. 2, 2000

(30) Foreign Application Priority Data

Oct. 6, 1999 (JP) ..... 11-285057

(51) Int. Cl.[7] ..... B43K 5/00
(52) U.S. Cl. ..... 401/199; 401/198
(58) Field of Search ..... 401/243, 202, 401/186, 196, 262, 269, 61, 52, 195, 199

(56) References Cited

U.S. PATENT DOCUMENTS

| | | | | |
|---|---|---|---|---|
| 3,993,409 | | 11/1976 | Hart | 401/199 |
| 4,382,707 | * | 5/1983 | Anderka | 401/198 |
| 5,897,265 | * | 4/1999 | Wilson | 401/198 |

FOREIGN PATENT DOCUMENTS

| | | | |
|---|---|---|---|
| 0 657 306 A1 | 11/1994 | (EP) | B23K/11/00 |
| 1 550 725 | 12/1968 | (FR) . | |
| 11-48679 | 2/1999 | (JP) | B43K/8/03 |

* cited by examiner

*Primary Examiner*—David J. Walczak
(74) *Attorney, Agent, or Firm*—Sughrue, Mion, Zinn, Macpeak & Seas, PLLC

(57) ABSTRACT

The writing implement 1 comprises a shaft barrel 4 and a tail plug 2. The shaft barrel 4 includes an ink storing body 7 stored in an interior portion thereof and a pen point 8 mounted on a front end portion thereof. The tail plug 2 is removably mounted on an opening formed at the rear end of the shaft barrel 4. The tail plug 2 includes a flange portion 21 which is provided backwardly of the rear end portion of the shaft barrel 4. Between the front surface of the flange portion 21 and the rear end portion of the shaft barrel 4, there is formed a groove 5 for forcibly opening. The groove 5 is formed more deeply inwardly in the diameter direction of the shaft barrel 4 than the inner surface of the rear end opening of the shaft barrel 4.

17 Claims, 6 Drawing Sheets

WRITING IMPLEMENT

BACKGROUND OF THE INVENTION

1. Field of the Invention

The present invention relates to a writing implement. In detail, the invention relates to a writing implement which comprises a shaft barrel storing ink in an interior portion thereof and a plug body (for example, a tail plug or a pen point hold body) removably mounted on one end of the shaft barrel. In the present invention, a term "front" means the pen point side of the writing implement, whereas a term "rear" means the tail plug side thereof. Also, an expression "front surface" means the axial-direction outer surface of the writing implement, whereas an expression "back surface" means the axial-direction inner surface thereof.

2. Description of the Related Art

Conventionally, for example, in Japanese Patent Unexamined Publication No. Hei. 11-48679, there is disclosed a writing implement in which, for the purpose of removing an ink storing body stored into an interior portion of a shaft barrel, a tail plug is removably mounted on an opening formed in a rear end portion of the shaft barrel. Further, between a flange portion of the tail plug and the rear end portion of the shaft barrel, there is formed a groove (a cutaway portion) into which a coin such as a ten-yen coin or a tool can be engaged. By engaging the coin into the groove, the tail plug can be forced open.

Also, in the above-cited publication, there is also disclosed a writing implement in which a pen point hold body including a pen point is removably mounted on an opening formed at a front end portion of a shaft barrel. Between a flange portion of the pen point hold body and the front end portion of the shaft barrel, there is formed a groove (a cutaway portion) similar to the above-mentioned structure.

However, in the above-mentioned conventional writing implements, since the groove for forcible opening is shallow inwardly in a diameter direction thereof, when forcing open the tail plug or pen point hold body, the coin or tool can be inserted into the groove only in a small amount. Namely, the tail plug or pen point hold body cannot be forced open easily; or, a large force is necessary to force open the tail plug or pen point hold body. Therefore, there is a fear that the end portion of the shaft barrel, the flange portion of the tail plug, or the flange portion of the pen point hold body can be damaged.

SUMMARY OF THE INVENTION

The present invention aims at solving the problems found in the above-mentioned conventional writing implements. Accordingly, it is an object of the invention to provide a writing implement in which a tail plug or pen point hold body can be easily removed from an end portion of a shaft barrel. Thus the end portion of the shaft barrel, a flange portion of the tail plug, or a flange portion of the pen point hold body can be fully prevented against damage.

[1] A writing implement, according to a first aspect of the invention, comprises: a shaft barrel storing ink in an interior portion thereof and having an opening at one end portion thereof; and a plug body removably mounted on the opening of the shaft barrel, the plug body comprising: a flange portion provided outwardly in an axial direction of the shaft barrel from the one end portion of the shaft barrel. In the writing implement, a forcibly opening groove is formed between one surface of the flange portion and the one end portion of the shaft barrel, the forcibly opening groove being formed more deeply inwardly in a diameter direction of the shaft barrel than an inner surface of the one end portion of the shaft barrel. (See FIGS. 1 to 8).

Since the forcibly opening groove 5, 5' is formed more deeply inwardly in the diameter direction of the shaft barrel 4 than the inner surface of one end opening of the shaft barrel 4, in case where a tool 9 such as a coin is inserted into the groove 5, 5', the diameter-direction inner end portion of the tool 9 is positioned more deeply than the inner surface of the one end opening of the shaft barrel 4.

Therefore, as shown in FIGS. 1 and 7, in case where the diameter-direction outer end portion of the tool 9 is pushed inwardly in the axial direction of the tool 9 with one end portion of the shaft barrel 4 as a fulcrum thereof, the surface of the diameter-direction inner end portion of the tool 9 is pressed against the back surface of the flange portion 21, 31 outwardly in the axial direction thereof. Namely, the plug body 2, 3 can be removed easily from one end opening of the shaft barrel 4 with a slight force. Also, not only by the above-mentioned forcibly opening method, as shown in FIGS. 6 and 8, by twisting a tool 9 which is inserted into the groove 5, 5', the plug body 2, 3 can be removed easily from one end opening of the shaft barrel 4.

Since the plug body 2, 3 can be removed easily from one end opening of the shaft barrel 4 using the tool 9, one end portion of the shaft barrel 4 as well as the flange portion 21, 31 of the plug body 2, 3 can be prevented against damage. At the same time, the mutual connection between the shaft barrel 4 and plug body 2, 3 can be strengthened. Therefore, unless a forcibly opening operation is executed using the tool 9, the plug body 2, 3 cannot be removed easily, which makes it possible to prevent the plug body 2, 3 against removal.

[2] According to a second aspect of the invention, in the writing implement 1 according to the first aspect of the invention, preferably, the plug body may further comprise: a fitting tubular portion fitted with the inner surface of the shaft barrel; and a connecting portion connecting together the fitting tubular portion and the flange portion, wherein a space is formed between an outer surface of the connecting portion and the inner surface of the one end portion of the shaft barrel, and connected to the forcibly opening groove.

Due to this structure, when removing the plug body 2, 3 using the forcibly opening operation (that is, the pressing operation or twisting operation) of the tool 9, the space 6, 6' provides an escape space for the plug body 2, 3 with respect to the tool 9. This makes it possible to prevent the back surface of the diameter-direction inner end portion of the tool 9 from being abutted on one end portion of the fitting tubular portion 23, 33 of the plug body 2, 3. Also, this makes it possible to separate the shaft barrel 4 and plug body 2, 3 greatly from each other simply by the forcibly opening operation of the tool 9, so that the removing operation of the plug body 2, 3 can be facilitated further.

[3] According to a third aspect of the invention, in the writing implement 1 according to the second aspect of the invention, preferably, the plug body may further comprise: a plurality of reinforcing ribs provided on the outer surface of the connecting portion, each of the reinforcing ribs extending in an axial direction of the plug body for connecting together the flange portion and the fitting tubular portion.

Due to this structure, the forcibly opening groove 5, 5' formed between one end portion of the shaft barrel 4 and the flange portion 21, 31 can be positioned between the respective reinforcing ribs 24, 34. At the same time, in the forcibly opening operation, the flange portion 21, 31 can be prevented from being unstable with respect to the fitting tubular portion 23, 33, so that the plug body 2, 3 can be removed in a stable manner.

[4] According to a fourth aspect of the invention, in the writing implement 1 according to the first aspect of the invention, the shaft barrel has a pen point at a front end thereof, the plug body is removably mounted on an opening formed at a rear end portion of the shaft barrel, and the flange portion is provided backwardly of the rear end portion of the shaft barrel, wherein the forcibly opening groove is formed between the one surface of the flange portion and the rear end portion of the shaft barrel, the forcibly opening groove being formed more deeply inwardly in the diameter direction of the shaft barrel than an inner surface of the rear end portion of the shaft barrel. (See FIGS. 1 to 6).

Due to this structure, since the forcibly opening groove 5 is formed more deeply inwardly in the diameter direction of the shaft barrel 4 than the inner surface of the rear end opening of the shaft barrel 4, in case where the tool 9 such as a coin is inserted into the groove 5, the inner end portion of the tool 9 can be positioned more deeply than the inner surface of the rear end opening of the shaft barrel 4.

Therefore, as shown in FIG. 1, in case where the outer end portion of the tool 9 is pushed forwardly with the rear end portion of the shaft barrel 4 as a fulcrum thereof, the rear surface of the inner end portion of the tool 9 is pressed against the front surface (back surface) of the flange portion 21 backwardly. Namely, the tail plug 2 (plug body) can be easily removed from the rear end opening of the shaft barrel 4 with a slight force. Also, besides the above-mentioned forcibly opening method, as shown in FIG. 6, using the twisting operation of the tool 9 inserted into the groove 5, the tail plug 2 can also be easily removed from the rear end opening of the shaft barrel 4.

Due to the fact that the tail plug 2 can also be easily removed from the rear end opening of the shaft barrel 4 using the tool 9, the rear end portion of the shaft barrel 4 and the flange portion 21 of the tail plug 2 can be prevented against damage. At the same time, the mutual connection between the shaft barrel 4 and tail plug 2 can be strengthened. Thus, unless a forcibly opening operation is executed using the tool 9, the tail plug 2 cannot be removed from the shaft barrel 4 easily, which can prevent the tail plug 2 from dropping off the shaft barrel 4.

Since the tail plug 2 can be mounted into and removed from the rear end opening of the shaft barrel 4, ink can be replenished into an ink storing body or an ink tank stored within the shaft barrel 4 through the rear end portion of the shaft barrel 4 with the tail plug 2 removed. The ink storing body or ink tank stored within the shaft barrel 4 can be removed from the shaft barrel 4 and can be replaced with new one, or the ink storing body or ink tank removed can be filled with ink again.

[5] According to a fifth aspect of the invention, in a writing implement according to the fourth aspect of the invention, preferably, the space may be formed between the outer surface of the connecting portion and the inner surface of the rear end portion of the shaft barrel.

Due to this structure, when removing the tail plug 2 using the forcibly opening operation (that is, the pressing operation or twisting operation) of the tool 9, the space 6 provides an escape space for the tail plug 2 with respect to the tool 9. This makes it possible to prevent the front surface of the inner end portion of the tool 9 from being abutted on the rear end portion of the fitting tubular portion 23 of the tail plug 2. Also, this makes it possible to separate the shaft barrel 4 and tail plug 2 greatly from each other simply by the forcibly opening operation of the tool 9, so that the removing operation of the tail plug 2 can be facilitated further.

[6] According to a sixth aspect of the invention, in the writing implement 1 according to the fifth aspect of the invention, preferably, the plug body may further comprise: a plurality of reinforcing ribs provided on the outer surface of the connecting portion, each of the reinforcing ribs extending in an axial direction of the plug body for connecting together the flange portion and the fitting tubular portion.

Due to this structure, the forcibly opening groove 5 formed between the rear end portion of the shaft barrel 4 and the flange portion 21 can be positioned between the respective reinforcing ribs 24. At the same time, in the forcibly opening operation, the flange portion 21 can be prevented from being unstable with respect to the fitting tubular portion 23, so that the tail plug 2 can be removed in a stable manner.

Each of the reinforcing ribs 24 may preferably include a stepped portion 24*a* to be abutted on the rear end portion of the shaft barrel 4 (that is, it may include a stopper function with respect to the rear end portion of the shaft barrel 4). Due to this, the forcibly opening groove 5 can be positively formed between the flange portion 21 and the rear end portion of the shaft barrel 4.

[7] According to a seventh aspect of the invention, in the writing implement 1 according to the first aspect of the invention, the plug body is removably mounted in an opening formed at a front end of the shaft barrel and has a pen point, and the flange portion is provided forwardly of the front end portion of the shaft barrel, wherein the forcibly opening groove is formed between the one surface of the flange portion and the front end portion of the shaft barrel, the forcibly opening groove being formed more deeply inwardly in the diameter direction of the shaft barrel than an inner surface of the front end portion of the shaft barrel. (See FIGS. 7 and 8).

Due to this structure, since the forcibly opening groove 5' is formed more deeply inwardly in the diameter direction of the shaft barrel 4 than the inner surface of the rear end opening of the shaft barrel 4, in case where the tool 9 such as a coin is inserted into the groove 5', the inner end portion of the tool 9 can be positioned more deeply than the inner surface of the front end opening of the shaft barrel 4.

Therefore, as shown in FIG. 7, in case where the outer end portion of the tool 9 is pushed backwardly with the front end portion of the shaft barrel 4 as a fulcrum thereof, the front surface of the inner end portion of the tool 9 is pressed against the rear surface (back surface) of the flange portion 31 forwardly. Namely, the pen point hold body 3 (plug body) can be easily removed from the front end opening of the shaft barrel 4 with a slight force. Also, besides the above-mentioned forcibly opening method, as shown in FIG. 8, by twisting the tool 9 which is inserted into the groove 5', the pen point hold body 3 can also be easily removed from the front end opening of the shaft barrel 4.

Due to the fact that the pen point hold body 3 can also be easily removed from the front end opening of the shaft barrel 4 using the tool 9, the front end portion of the shaft barrel 4 and the flange portion 31 of the pen point hold body 3 can be prevented against damage. At the same time, the mutual connection between the shaft barrel 4 and pen point hold body 3 can be strengthened. Thus, unless a forcibly opening operation is executed using the tool 9, the pen point hold body 3 cannot be removed from the shaft barrel 4 easily, which can prevent the pen point hold body 3 from dropping off the shaft barrel 4.

Since the pen point hold body 3 can be mounted into and removed from the front end opening of the shaft barrel 4, ink can be replenished into an ink storing body or an ink tank stored within the shaft barrel 4 through the front end portion of the shaft barrel 4 with the pen point hold body 3 removed. The ink storing body or ink tank stored within the shaft barrel 4 can be removed from the shaft barrel 4 and can be replaced with new one, or the ink storing body or ink tank removed can be filled with ink again.

The writing implement according to the seventh aspect of the invention, may further comprise: a rear plug body removably mounted in an opening formed at a rear end portion of the shaft barrel, the rear plug body including a rear pen point and a rear flange portion provided backwardly of the rear end portion of the shaft barrel, wherein a rear forcibly opening groove is formed between one surface of the rear flange portion and the rear end portion of the shaft barrel, the rear forcibly opening groove being formed more deeply inwardly in the diameter direction of the shaft barrel than an inner surface of the rear end portion of the shaft barrel.

[8] According to a eighth aspect of the invention, in the writing implement 1 according to the seventh aspect of the invention, preferably, the space may be formed between the outer surface of the connecting portion and the inner surface of the front end portion of the shaft barrel.

Due to this structure, when removing the pen point hold body 3 using the forcibly opening operation (that is, pressing operation or twisting operation) of the tool 9, the space 6 provides an escape space for the pen point hold body 3 with respect to the tool 9. This makes it possible to prevent the rear surface of the inner end portion of the tool 9 from being abutted on the front end portion of the fitting tubular portion 33 of the pen point hold body 3. Also, this makes it possible to separate the shaft barrel 4 and pen point hold body 3 greatly from each other simply by the forcibly opening operation of the tool 9, so that the removing operation of the pen point hold body 3 can be facilitated further.

[9] According to a ninth aspect of the invention, in the writing implement 1 according to the eighth aspect of the invention, preferably, the plug body may further comprise: a plurality of reinforcing ribs provided on the outer surface of the connecting portion, each of the reinforcing ribs extending in an axial direction of the plug body for connecting together the flange portion and the fitting tubular portion.

Due to this structure, the forcibly opening groove 5' formed between the front end portion of the shaft barrel 4 and the flange portion 31 can be positioned between the respective reinforcing ribs 34. At the same time, in the forcibly opening operation, the flange portion 31 can be prevented from being unstable with respect to the fitting tubular portion 33, so that the pen point hold body 3 can be removed in a stable manner.

Each of the reinforcing ribs 34 may preferably include a stepped portion 34*a* to be abutted on the front end portion of the shaft barrel 4 (that is, it may include a stopper function with respect to the front end portion of the shaft barrel 4). Due to this, the forcibly opening groove 5' can be positively formed between the flange portion 31 and the front end portion of the shaft barrel 4.

DETAILED DESCRIPTION OF THE PREFERRED EMBODIMENT

Figure 1:
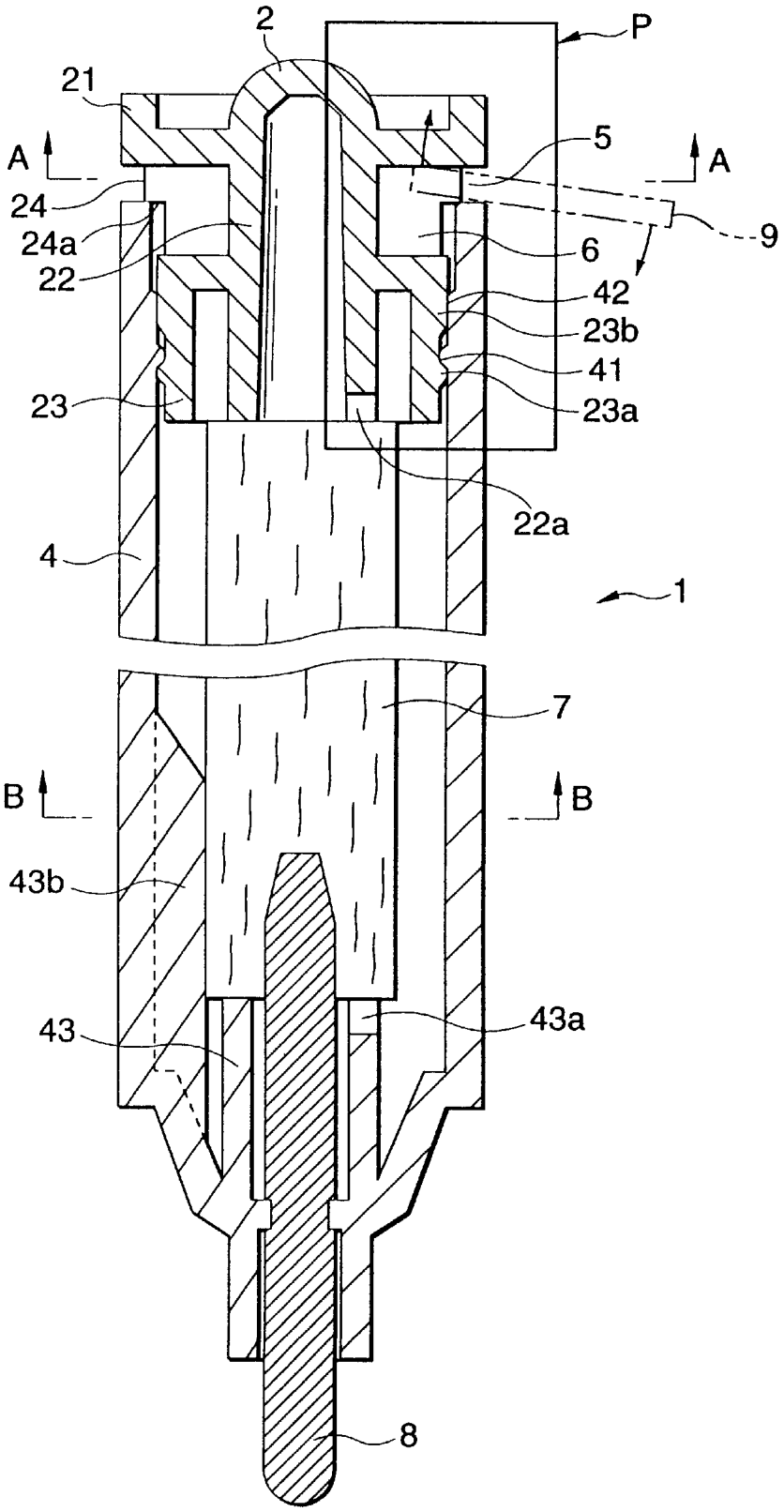
FIG. 1 is a longitudinal section view of a first embodiment of a writing implement according to the invention.
Figure 2:
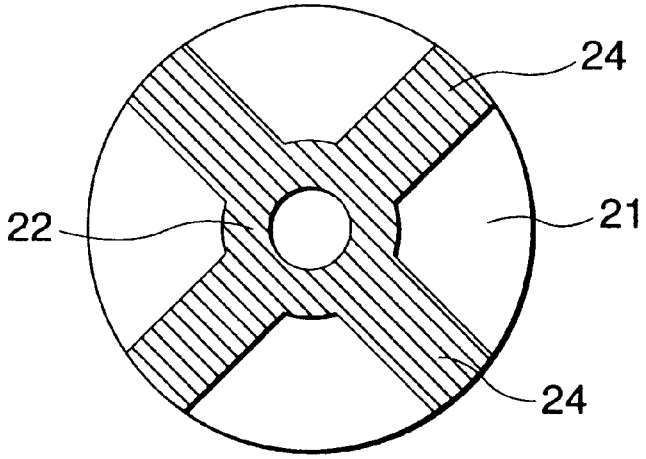
FIG. 2 is a section view taken along the arrow line A—A shown in FIG. 1.
Figure 3:
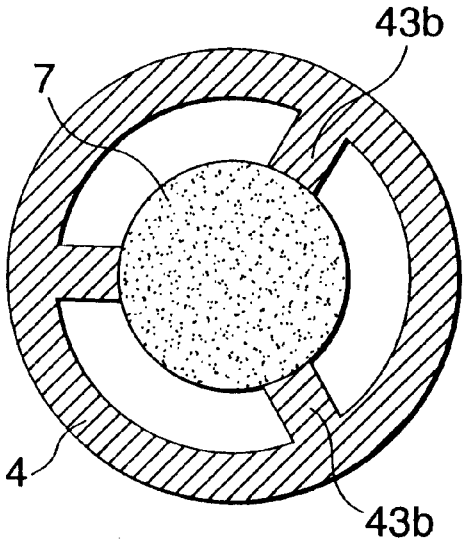
FIG. 3 is a section view taken along the arrow line B—B shown in FIG. 1.
Figure 4:
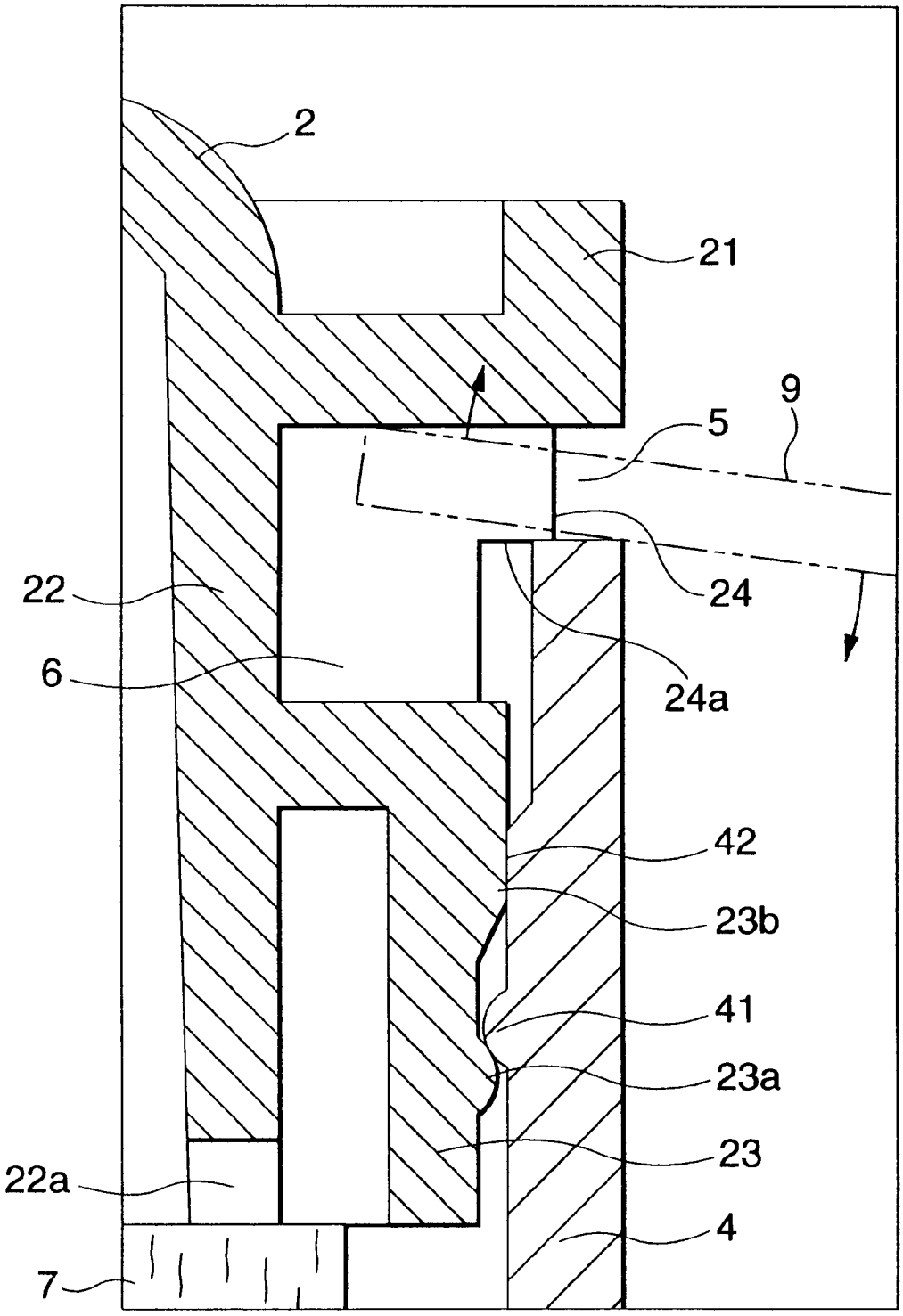
FIG. 4 is an enlarged view of a portion P shown in FIG. 1.
Figure 5:
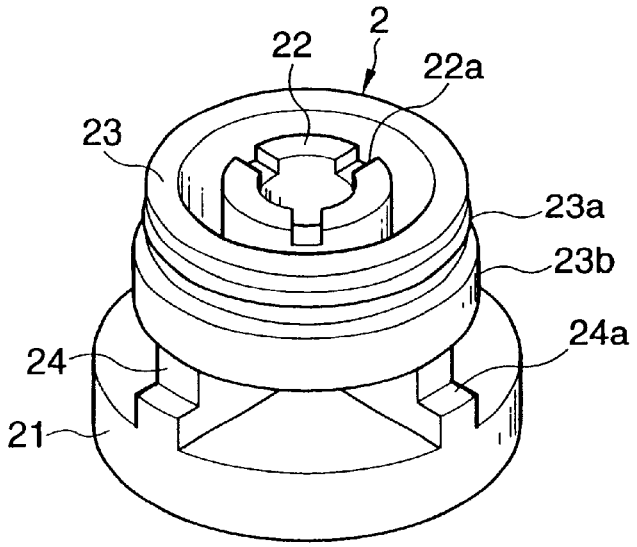
FIG. 5 is a perspective view of a tail plug shown in FIG. 1.
Figure 6:
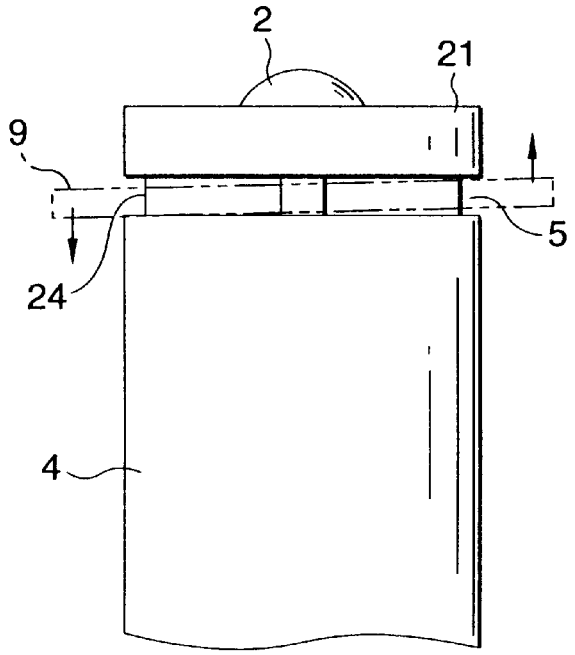
FIG. 6 is an enlarged view of the portion P of the rear end portion of the writing implement shown in FIG. 1.
Figure 7:
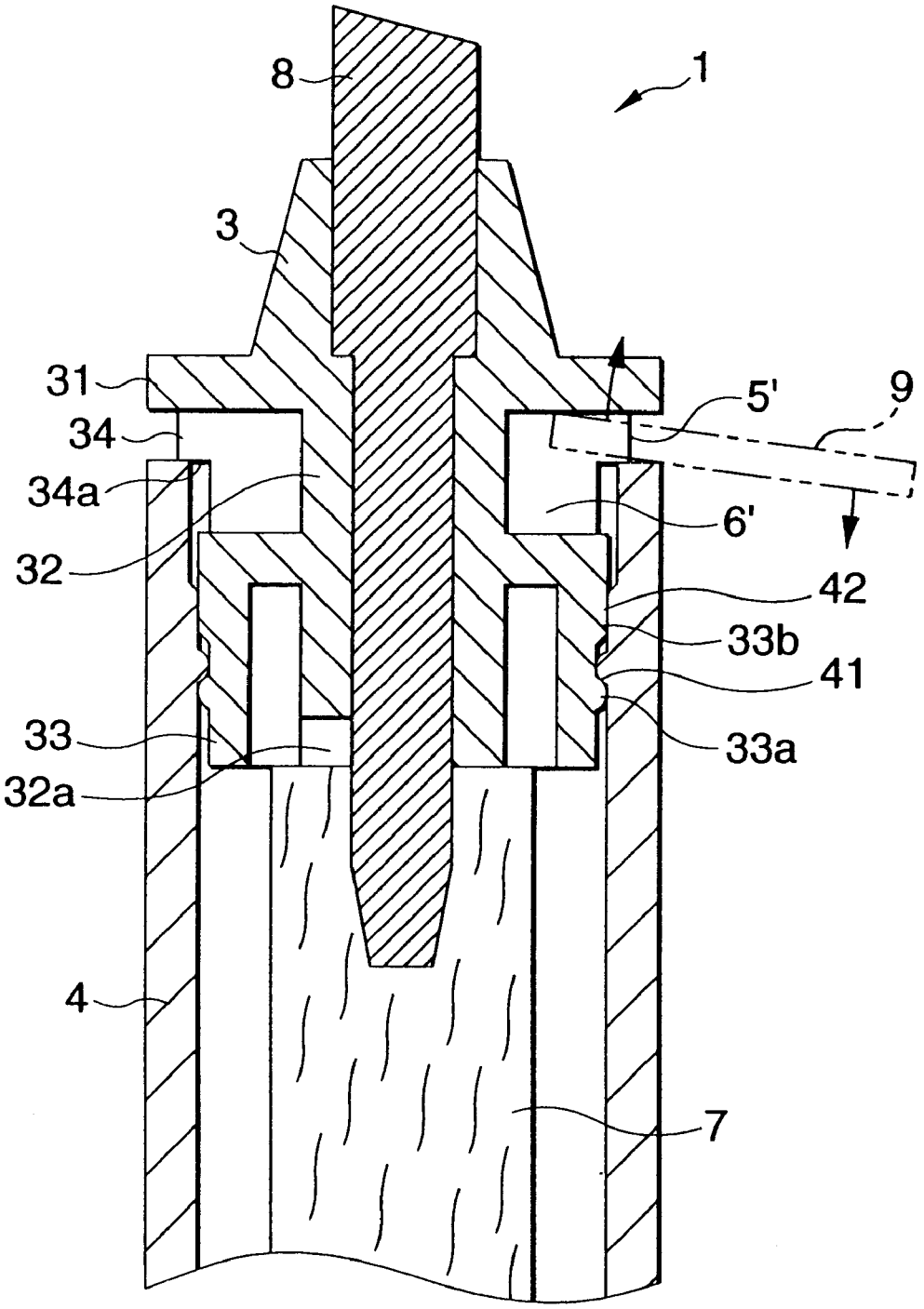
FIG. 7 is a longitudinal section view of the main portions of a second embodiment of a writing implement according to the invention.
Figure 8:
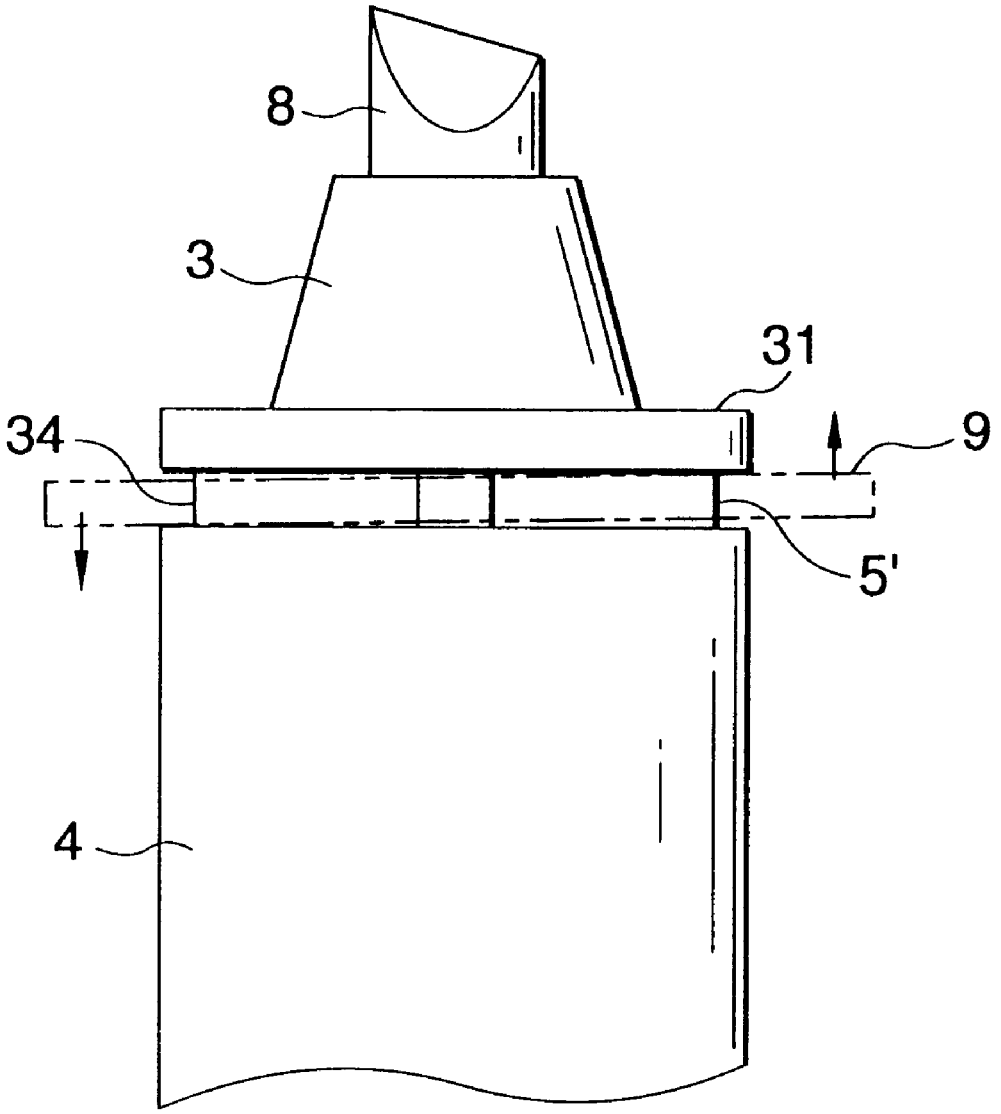
FIG. 8 is an enlarged view of the front end portion of the writing implement shown in FIG. 7.

Now, description will be given below of the preferred embodiments of a writing implement according to the invention with reference to the accompanying drawings. FIGS. 1 to 6 respectively show a first embodiment of a writing implement according to the invention. FIGS. 7 and 8 show a second embodiment of a writing implement according to the invention.

FIRST EMBODIMENT

Now, description will be given below of the first embodiment (see FIGS. 1 to 6).

(Summary of the structure of the first embodiment)

A writing implement 1 comprises a shaft barrel 4 and a tail plug 2. The shaft barrel 4 includes an ink storing body 7 stored in an interior portion thereof and a pen point 8 mounted on a front end portion thereof. The tail plug 2 is removably mounted on an opening formed at a rear end (hereinafter referred to "rear end opening") of the shaft barrel 4.

(Shaft barrel)

The shaft barrel 4 can be formed of synthetic resin (for example, polypropylene) by injection molding. The front end portion of the shaft barrel 4 is reduced in diameter in a tapered manner, while the pen point 8 is held in the tapered front end portion of the shaft barrel 4. Also, the shaft barrel 4 has a tubular portion 43 which is provided on an inner surface of the front end portion of the shaft barrel 4 and encloses the outer periphery of the pen point 8. The tubular portion 43 is formed integral with the inner surface of the shaft barrel 4 and projects therefrom in the axial direction of the shaft barrel 4. A rear end portion of the tubular portion 43 and a front end portion of the ink storing body 7 are abutted on each other in the axial direction of the shaft barrel 4. Further, in the rear end portion of the tubular portion 43, there is formed a notch 43*a* for ventilation.

Also, the shaft barrel 4 has a plurality of (specifically, three) support ribs 43*b* which are provided on the rear portion of the tubular portion 43. The support ribs 43*b* are formed integral with the shaft barrel 4 and extend in the axial direction of the shaft barrel 4. The outer peripheral surface of the front end portion of the ink storing body 7 is pressure contacted with and supported by the support ribs 43*b* in the diameter direction of the ink storing body 7.

The ink storing body 7 is composed of a worked body of synthetic resin fibers (for example, a bundled body of polyester fibers with its outer periphery coated by a film, or a worked body of thermally welded polyester fibers or a resin worked body). Ink is impregnated into the interior portion of the ink storing body 7. The pen point 8 is a bar-shaped resin worked body of synthetic resin fibers (for example, acrylic fibers or polyester fibers). The rear end portion of the pen point 8 is stuck into and connected to the front end portion of the ink storing body 7.

(Tail plug)

The tail plug 2 can be formed of synthetic resin (for example, polypropylene) by injection molding. The tail plug 2 comprises a bottomed, cylinder-shaped connecting portion 22, a bottomed, cylinder-shaped fitting tubular portion 23 and a disk-shaped flange portion 21. The fitting tubular portion 23 is formed so as to be integral and continuous with the outer peripheral surface of the central portion of the connecting portion 22. The flange portion 21 is formed so as to be integral and continuous with the outer peripheral surface of the rear portion of the connecting portion 22. The front portion of the connecting portion 22 includes a notch for ventilation 22*a* as well as it touches and supports the rear end portion of the ink storing body 7 in the axial direction thereof.

(Forcibly opening groove)

In a state where the tail plug 2 is mounted on the rear end opening of the shaft barrel 4, the outer periphery of the fitting tubular portion 23 is fitted with the inner surface of the rear end opening of the shaft barrel 4. At the same time, between the front surface of the flange portion 21 and the rear end portion of the shaft barrel 4, there is formed a forcibly opening groove 5 which opens outwardly in the diameter direction thereof. The axial-direction width dimension of the groove 5 may be preferably of 2 mm or less so that an ordinary coin (for example, a ten-yen coin, a hundred-yen coin, and a five-hundred-yen coin) can be used as a tool 9. Also, in order to be able to further facilitate the removal of the tail plug 2, the diameter-direction depth dimension of the groove 5 may be preferably of 3 mm or more inwardly in the diameter direction thereof from the outer peripheral surface of the rear end opening of the shaft barrel 4.

(Airtight fitting portion)

The fitting tubular portion 23 has an annular projection 23*a* which is provided on the outer peripheral surface of the fitting tubular portion 23. The annular projection 23*a* is formed integral with the fitting tubular portion 23 and projects therefrom. The shaft barrel 4 has an annular projection 41 which is formed integral with the inner peripheral surface of the rear end opening of the shaft barrel 4. When the tail plug 2 is mounted on the rear end portion of the shaft barrel 4, the annular projection 23*a* passes over the annular projection 41, so as to be fitted with the annular projection 41. Further, the fitting tubular portion 23 has an annular smooth surface 23*b* which is provided on the outer peripheral surface of the portion of the fitting tubular portion 23 that is situated in the rear of the annular projection 23*a*. The shaft barrel 4 has an annular smooth surface 42 which is formed in the rear of the annular projection 41 on the inner peripheral surface of the rear end opening of the shaft barrel 4. The annular smooth surface 23*b* is pressure contacted and fitted with the annular smooth surface 42. That is, between the outer peripheral surface of the fitting tubular portion 23 and the inner peripheral surface of the rear end opening of the shaft barrel 4, there is formed an airtight fitting portion which consists of the pass-over fitting portion and pressure-contact fitting portion. The fitted state of the airtight fitting portion (that is, the pass-over fitting portion and pressure-contact fitting portion) can be removed by a forcibly opening operation.

(Reinforcing rib)

The tail plug 2 also has a plurality of (here, four) plate-shaped reinforcing ribs 24 which provided on the diameter-direction outer peripheral surface of the portion of the connecting portion 22 between the front surface (back surface) of the flange portion 21 and the bottom wall of the fitting tubular portion 23 (that is, the rear end portion of the fitting tubular portion 23). The plate-shaped reinforcing ribs 24 are radially formed integral with the present outer peripheral surface. The flange portion 21 and the bottom wall of fitting tubular portion 23 can be connected together by the reinforcing ribs 24, which makes it possible to prevent the flange portion 21 from being unstable in the forcibly opening operation.

Each of the reinforcing ribs 24 includes, in the rear end portion thereof, a stepped portion 24*a* having an outside diameter larger than the inside diameter of the rear end opening of the shaft barrel 4. Specifically, when the tail plug 2 is mounted on the rear end opening of the shaft barrel 4, the stepped portion 24*a* is abutted on the rear end portion of the shaft barrel 4. Namely, the groove 5 can be positively formed so as to have a width dimension which allows the tool 9 such as a coin to be inserted into the groove 5. Also, the portion of the reinforcing rib 24 that is located in front of the stepped portion 24*a* is kept away from contact with the inner surface of the rear end opening of the shaft barrel 4 and is stored into the interior portion of the rear end opening of the shaft barrel 4.

The distance between the flange portion 21 and the bottom wall of the fitting tubular portion 23 (that is, the axial-direction length of the reinforcing rib 24) is set larger than the width dimension of the groove 5 (that is, the axial-direction length of the stepped portion 24*a*). Due to this distance setting, there can be formed a space 6 which provides an escape space for the tail plug 2 with respect to the tool 9 in the forcibly opening operation. This makes it possible to prevent the front surface of the inner end portion of the tool 9 from being abutted on the bottom wall of the fitting tubular portion 23 of the tail plug 2. Therefore the shaft barrel 4 and tail plug 2 can be separated from each other simply by the forcibly opening operation of the tool 9.

SECOND EMBODIMENT

Now, description will be given below of a second embodiment of a writing implement according to the invention. (see FIGS. 7 and 8).

(Summary of the structure of the second embodiment)

A writing implement 1 comprises a shaft barrel 4 (which, similarly to the first embodiment, is an injection-molded body of synthetic resin) and another plug body in the form of a pen point hold body 3. The shaft barrel 4 stores an ink storing body 7 (which, similarly to the first embodiment, is a worked body of synthetic resin fibers) in the interior portion thereof. The pen point hold body 3 is removably mounted on an opening formed at the front end (hereinafter referred to "front end opening") of the shaft barrel 4 and includes a pen point 8 (which, similarly to the first embodiment, is a bar-shaped resin worked body of synthetic resin).

(Pen point hold body)

The pen point hold body 3 can be formed of synthetic resin (for example, polypropylene) by injection molding. The pen point hold body 3 comprises a cylindrical-shaped connecting portion 32, a disk-shaped flange portion 31 and a bottomed, cylindrical-shaped fitting tubular portion 33. The connecting portion 32 holds the outer surface of the pen point 8. The flange portion 31 is disposed on the outer peripheral surface of the front portion of the connecting portion 32 in such a manner that it is formed so as to be integral and continuous with the present outer peripheral surface. The fitting tubular portion 33 is disposed on the outer peripheral surface of the rear end portion of the connecting portion 32 in such a manner that it is formed so as to be integral and continuous with the present outer peripheral surface. The rear end portion of the connecting portion 32 not only includes a notch 32*a* for ventilation but also can be abutted on the front end portion of the ink storing body 7 in the axial direction thereof to thereby support the same.

(Forcibly opening groove)

In a state where the pen point hold body 3 is mounted on the front end opening of the shaft barrel 4, the outer periphery of the fitting tubular portion 33 is fitted with the inner surface of the front end opening of the shaft barrel 4. At the same time, between the rear surface of the flange portion 31 and the front end portion of the shaft barrel 4, there is formed a forcibly opening groove 5' which opens outwardly in the diameter direction thereof. The width dimension of the groove 5' may be preferably of 2 mm or less so that an ordinary coin (for example, a ten-yen coin, a hundred-yen coin, and a five-hundred-yen coin) can be used as a tool 9. Also, in order to be able to further facilitate the removal of the pen point hold body 3, the diameter-direction depth dimension of the groove 5' may be preferably of 3 mm or more inwardly in the diameter direction thereof from the outer peripheral surface of the front end opening of the shaft barrel 4.

(Airtight fitting portion)

The fitting tubular portion 33 has an annular projection 33*a* which is provided on the outer peripheral surface of the fitting tubular portion 33. The annular projection 33*a* is formed integral with the fitting tubular portion 33 and projects therefrom. The shaft barrel 4 has an annular projection 41 which is formed integral with the inner peripheral surface of the front end opening of the shaft barrel 4. When the pen point hold body 3 is mounted on the front end portion of the shaft barrel 4, the annular projection 33*a* passes over the annular projection 41, so as to be fitted with the annular projection 41. Further, the pen point hold body 3 has an annular smooth surface 33*b* which is provided on the outer peripheral surface of the portion of the fitting tubular portion 33 that is situated in the front of the annular projection 33*a*. The shaft barrel 4 has an annular smooth surface 42 which is formed in front of the annular projection 41 on the inner peripheral surface of the front end opening of the shaft barrel 4. The annular smooth surface 33*b* is pressure contacted and fitted with the annular smooth surface 42. That is, similarly to the first embodiment, between the outer peripheral surface of the fitting tubular portion 33 and the inner peripheral surface of the front end opening of the shaft barrel 4, there is formed an airtight fitting portion which consists of the pass-over fitting portion and pressure-contact fitting portion. The fitted state of the airtight fitting portion (that is, the pass-over fitting portion and pressure-contact fitting portion) can be removed by a forcibly opening operation.

(Reinforcing rib)

The pen point hold body 3, similarly to the first embodiment, has a plurality of (here, four) plate-shaped reinforcing ribs 34 which are provided on the diameter-direction outer peripheral surface of the portion of the connecting portion 32 between the rear surface (back surface) of the flange portion 31 and the bottom wall of the fitting tubular portion 33 (that is, the front end portion of the fitting tubular portion 33). The plate-shaped reinforcing ribs 34 are radially formed integral with the present outer peripheral surface. The flange portion 31 and the bottom wall of the fitting tubular portion 33 can be connected together by the reinforcing ribs 34, which makes it possible to prevent the flange portion 31 from being unstable in the forcibly opening operation.

Each of the reinforcing ribs 34 includes, in the front end portion thereof, a stepped portion 34*a* having an outside diameter larger than the inside diameter of the front end opening of the shaft barrel 4. Specifically, when the pen point hold body 3 is mounted on the front end opening of the shaft barrel 4, the stepped portion 34*a* is abutted on the front end portion of the shaft barrel 4. Namely, the groove 5' can be positively formed so as to have a width dimension which allows the tool 9 such as a coin to be inserted into the groove 5'. Also, the portion of the reinforcing rib 34 that is located in the rear of the stepped portion 34*a* is kept away from contact with the inner surface of the front end opening of the shaft barrel 4 and is stored into the interior portion of the front end opening of the shaft barrel 4.

The distance between the flange portion 31 and the bottom wall of the fitting tubular portion 33 (that is, the axial-direction length of the reinforcing rib 34) is set larger than the width dimension of the groove 5' (that is, the axial-direction length of the stepped portion 34*a*). Due to such distance setting, there can be formed a space 6' which provides an escape space for the pen point hold body 3 with respect to the tool 9 in the forcibly opening operation. This makes it possible to prevent the rear surface of the inner end portion of the tool 9 from being abutted on the bottom wall of the fitting tubular portion 33 of the pen point hold body 3, and therefore the shaft barrel 4 and pen point hold body 3 can be separated from each other simply by the forcibly opening operation of the tool 9.

(Others)

In the writing implement 1 according to the first embodiment, the tail plug 2 may be replaced with the pen point hold body 3 according to the second embodiment. Also, writing implement 1 according to the second embodiment, may have another pen point hold body removably mounted on the opening formed at the rear end of the shaft barrel. That is, the writing implement 1 may be a two-head-type writing implement which includes two pen points in the two ends thereof.

As the above-mentioned pen point 8, there can be used other bodies than the fiber worked body; for example, a pen body formed of synthetic resin by extrusion molding, a ball-point pen tip, a pipe-shaped pen body, a plate-shaped pen body including a slit in the front end thereof, a writing brush body, and a porous pen body.

According to the first aspect of the invention, the plug body can be easily removed from one end portion of the shaft barrel. At the same time, the flange portion of the plug body and one end portion of the shaft barrel can be sufficiently prevented against damage.

According to the second aspect of the invention, there can be formed the escape space for the plug body with respect to a tool in a forcibly opening operation. Namely, the back surface of the tool can be prevented from being abutted on the end portion of the fitting tubular portion of the plug body, and the shaft barrel and plug body can be separated greatly away from each other simply by the forcibly opening operation of the tool.

According to the third aspect of the invention, in the forcibly opening operation, the flange portion can be prevented from being unstable, which makes it possible to remove the plug body in a stable manner.

According to the fourth aspect of the invention, the tail plug can be easily removed from the rear end portion of the shaft barrel. At the same time, the flange portion of the tail plug and the rear end portion of the shaft barrel can be sufficiently prevented against damage.

According to the fifth aspect of the invention, there can be formed an escape space for the tail plug with respect to the tool in the forcibly opening operation of the tool. Namely, the front surface of the tool can be prevented from being abutted on the rear end portion of the fitting tubular portion of the tail plug, and the shaft barrel and tail plug can be separated greatly away from each other simply by the forcibly opening operation of the tool.

According to the sixth aspect of the invention, in the forcibly opening operation, the flange portion can be prevented from being unstable, which makes it possible to remove the tail plug in a stable manner.

According to the seventh aspect of the invention, the pen point hold body can be easily removed from the front end portion of the shaft barrel. At the same time, the flange portion of the pen point hold body and the front end portion of the shaft barrel can be sufficiently prevented against damage.

According to the eighth aspect of the invention, there can be formed an escape space for the pen point hold body with respect to the tool in the forcibly opening operation of the tool. Namely, the rear surface of the tool can be prevented from being abutted on the front end portion of the fitting tubular portion of the pen point hold body, and the shaft barrel and pen point hold body can be separated greatly away from each other simply by the forcibly opening operation of the tool.

According to the ninth aspect of the invention, in the forcibly opening operation, the flange portion can be prevented from being unstable, which makes it possible to remove the pen point hold body in a stable manner.

What is claimed is:

1. A writing implement comprising:

a shaft barrel storing ink in an interior portion thereof and having an opening at one end portion thereof; and a plug body removably mounted on the opening of said shaft barrel, said plug body comprising:

a flange portion provided outwardly in an axial direction of said shaft barrel from the one end portion of said shaft barrel, wherein a forcibly opening groove is formed between one surface of the flange portion and the one end portion of said shaft barrel, said forcibly opening groove being formed more deeply inwardly in a diameter direction of said shaft barrel than an inner surface of the one end portion of said shaft barrel.

2. The writing implement as set forth in claim 1, wherein said plug body further comprises:

a fitting tubular portion fitted with the inner surface of said shaft barrel; and a connecting portion connecting together said fitting tubular portion and said flange portion, wherein a space is formed between an outer surface of said connecting portion and the inner surface of the one end portion of said shaft barrel, and connected to the forcibly opening groove.

3. The writing implement as set forth in claim 2, wherein said fitting tubular portion has an annular projection formed integral therewith and projects therefrom and an annular smooth surface, said annular projection and said annular smooth surface being provided on an outer peripheral surface of said fitting tubular portion.

4. The writing implement as set forth in claim 2, wherein said plug body further comprises:

a plurality of reinforcing ribs provided on the outer surface of said connecting portion, each of said reinforcing ribs extending in an axial direction of said plug body for connecting together said flange portion and said fitting tubular portion.

5. The writing implement as set forth in claim 4, wherein each of said reinforcing ribs has a stepped portion contacting with the one end portion of said shaft barrel.

6. The writing implement as set forth in claim 1, wherein said shaft barrel has a pen point at a front end thereof, said plug body is removably mounted on an opening formed at a rear end portion of said shaft barrel, and said flange portion is provided backwardly of the rear end portion of said shaft barrel, wherein said forcibly opening groove is formed between the one surface of said flange portion and the rear end portion of said shaft barrel, said forcibly opening groove being formed more deeply inwardly in the diameter direction of said shaft barrel than an inner surface of the rear end portion of said shaft barrel.

7. The writing implement as set forth in claim 6, wherein a space is formed between the outer surface of said connecting portion and the inner surface of the rear end portion of said shaft barrel.

8. The writing implement as set forth in claim 7, said plug body further comprises:

a plurality of reinforcing ribs provided on the outer surface of said connecting portion, each of said reinforcing ribs extending in an axial direction of said plug body for connecting together said flange portion and said fitting tubular portion.

9. The writing implement as set forth in claim 8, wherein each of said reinforcing ribs has a stepped portion contacting with the rear end portion of said shaft barrel.

10. The writing implement as set forth in claim 1, wherein said plug body is removably mounted in an opening formed at a front end of said shaft barrel and has a pen point, and said flange portion is provided forwardly of the front end portion of said shaft barrel, wherein said forcibly opening groove is formed between the one surface of said flange portion and the front end portion of said shaft barrel, said forcibly opening groove being formed more deeply inwardly in the diameter direction of said shaft barrel than an inner surface of the front end portion of said shaft barrel.

11. The writing implement as set forth in claim 10, further comprising:

a rear plug body removably mounted in an opening formed at a rear end portion of said shaft barrel, said rear plug body including a rear pen point and a rear flange portion provided backwardly of the rear end portion of said shaft barrel, wherein a rear forcibly opening groove is formed between one surface of said rear flange portion and the rear end portion of said shaft barrel, said rear forcibly opening groove being formed more deeply inwardly in the diameter direction of said shaft barrel than an inner surface of the rear end portion of said shaft barrel.

12. The writing implement as set forth in claim 10, wherein said shaft barrel has a rear pen point at a rear end thereof.

13. The writing implement as set forth in claim 10, wherein a space is formed between the outer surface of said connecting portion and the inner surface of the front end portion of said shaft barrel.

14. The writing implement as set forth in claim 13, said plug body further comprises:

a plurality of reinforcing ribs provided on the outer surface of said connecting portion, each of said reinforcing ribs extending in an axial direction of said plug body for connecting together said flange portion and said fitting tubular portion.

15. The writing implement as set forth in claim 14, wherein each of said reinforcing ribs has a stepped portion contacting with the front end portion of said shaft barrel.

16. The writing implement as set forth in claim 1, wherein an axial-direction width dimension of said forcibly opening groove is set at 2 mm or less.

17. The writing implement as set forth in claim 1, wherein a diameter-direction depth dimension of said forcibly opening groove is set at 3 mm or more inwardly in the diameter direction of said shaft barrel from the outer surface of the one end portion of said shaft barrel.

* * * * *